US006729286B2

(12) United States Patent
Onishi et al.

(10) Patent No.: US 6,729,286 B2
(45) Date of Patent: May 4, 2004

(54) FUEL SUPPLY APPARATUS FOR ENGINE

(75) Inventors: Yoshihiko Onishi, Tokyo (JP); Takuya Uryu, Tokyo (JP); Hiromichi Tsugami, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 65 days.

(21) Appl. No.: 10/118,906

(22) Filed: Apr. 10, 2002

(65) Prior Publication Data

US 2003/0062085 A1 Apr. 3, 2003

(30) Foreign Application Priority Data

Oct. 2, 2001 (JP) ..... P2001-306831

(51) Int. Cl.[7] ..... F01L 1/14

(52) U.S. Cl. ..... 123/90.48; 123/90.51; 123/495

(58) Field of Search ..... 123/90.48, 90.51, 123/495, 508

(56) References Cited

U.S. PATENT DOCUMENTS 1,551,948 A * 9/1925 Germonprez ..... 123/90.51
3,089,473 A * 5/1963 Kueny ..... 123/90.51
3,238,933 A * 3/1966 Humphreys ..... 93/90.51
4,850,095 A * 7/1989 Akao et al. ..... 29/447
5,190,444 A * 3/1993 Grinsteiner et al. ..... 417/254
5,752,430 A * 5/1998 Kawajiri et al. ..... 92/129
2002/0170516 A1 * 11/2002 Bretting et al. ..... 123/90.48

FOREIGN PATENT DOCUMENTS

| | | |
|---|---|---|
| JP | 58-146879 | 10/1983 |
| JP | 63-14863 | 1/1988 |
| JP | 1-63701 | 4/1989 |
| JP | 8-232795 | 9/1996 |
| JP | 11-153069 | 6/1999 |
| WO | WO 02/16756 A1 | 2/2002 |

* cited by examiner

*Primary Examiner*—Thomas N. Moulis
(74) *Attorney, Agent, or Firm*—Sughrue Mion, PLLC

(57) ABSTRACT

A fuel supply apparatus capable of reducing the abrasion of a driving cam and a tappet without increasing the dimensions and weight of the apparatus. This fuel supply apparatus is provided with a tappet which has a pressure receiving surface contacting the driving cam of an engine. The tappet is provided at the part of a outer surface thereof which is in the vicinity of an outer circumference of the pressure receiving surface with a groove adapted to prevent the local concentration of stress on the tappet and having a V-shaped, semicircular or U-shaped cross section.

8 Claims, 8 Drawing Sheets

Prior Art

Prior Art

Prior Art

Prior Art

FUEL SUPPLY APPARATUS FOR ENGINE

BACKGROUND OF THE INVENTION

1. Field of the Invention

This invention relates to a fuel supply apparatus, and more particularly to a fuel supply apparatus for supplying a fuel under a high pressure to a fuel injection type internal combustion engine, for example, an automobile engine.

2. Description of the Related Art

FIGS. 8 to 14 are drawings describing a related art general fuel supply system for a fuel injection type internal combustion engine. FIG. 8 is a schematic illustration of this fuel supply system, FIG. 9 a sectional view of a principal portion of a fuel supply apparatus included in this fuel supply system, FIG. 10 a sectional view taken along the line X—X in FIG. 9, FIG. 11 a partial enlarged sectional view of what is shown in FIG. 9, taken along a plane Y-Z and illustrating the contacting condition of a driving cam and a tappet of the fuel supply apparatus, FIG. 12 a sectional view taken along a plane Y-X with respect to the plane Y-Z in FIG. 11, FIG. 13 a graph showing the condition of the deformation of a pressure receiving surface of the tappet which receives a force of the driving cam, and FIG. 14 a graph showing the condition of the distribution of Hertz stress on the pressure receiving surface.

Referring to FIGS. 8 to 9, the fuel supply system includes a fuel tank 1, a fuel supply apparatus 6 and fuel injection valves 10 as main elements, the fuel supply apparatus 6 having a filter 11, a low-pressure damper 12, a suction valve 13, an electromagnetic valve 17, a pump 16, and a discharge valve 14.

Fuel 2 in the fuel tank 1 is sent out by the low-pressure pump 3, pressure regulated by a low-pressure regulator 5 via the filter 4, and supplied to the fuel supply apparatus 6. Only such a quantity of the fuel 2 thus supplied to the apparatus that is necessary for fuel injection is pressure-increased by the fuel supply apparatus 6, and supplied to a common rail 9 of an internal combustion engine (not shown), the fuel being then injected as a high-pressure atomized fuel from the fuel injection valves 10 into cylinders (not shown) of the internal combustion engine. The quantity of fuel needed during this time is determined by a control unit (not shown) and controlled by the electromagnetic valve 17, and an excess fuel is discharged from the electromagnetic valve 17 to the portion of a fuel passage which is between the low-pressure damper 12 and suction valve 13. A reference numeral 7 in FIG. 8 denotes a filter, and 8 a high-pressure relief valve, which is opened when the pressure in the interior of the common rail becomes abnormally high, to prevent the common rail 9 and fuel injection valve 10 from being broken.

Referring to FIG. 9 showing a principal portion of the fuel supply apparatus 6, the pump 16 includes a cylinder 25 incorporated in a cylinder casing 30 and provided with a pressure chamber 24 therein which has a fuel suction port 22 and a fuel discharge port 23; a piston 26 moving slidingly in the axial direction thereof in the cylinder 25 to vary the volume of the pressure chamber 24; a columnar tappet 28 joined to the piston 26; and a bolt 29 fitted slidably around the tappet 28 and having a threaded portion engaged with the cylinder casing 30. Referring to FIGS. 10 to 12, a driving cam 41 mounted on a cam shaft 40 of the engine contacts a pressure receiving surface 28*a* at a lower end in the drawing of the tappet 28, and a rotational force of the driving cam 41 occurring due to the rotation of the cam shaft 40 is transmitted to the tappet 28 and piston 26 via the pressure receiving surface 28*a* as a driving force. Owing to the driving force thus transmitted to the piston 26, the piston 26 is moved vertically to vary the volume of the pressure chamber 24.

A surface 261, which contacts the tappet 28, of the piston 26 bulges slightly toward the tappet 28 as shown in FIGS. 11 and 12. The reason why the surface 261 is thus bulged resides in that, when the tappet 28 is moved slidingly in the axial direction owing to the rotation of the driving cam 41, inclination of the tappet 28 occurs due to a clearance set between the tappet 28 and bolt 29, which inclination reduces a lateral force transmitted from an upper surface 28*b* of the tappet 28 to the piston 26.

Referring to FIG. 11, all of arrows a, b, c represent positions from which a force from the driving cam 41 is applied to the pressure receiving surface 28*a*. Out of these arrows, the arrow b represents a position from which the force is applied to the portion of the pressure receiving surface 28*a* which is close to the center thereof, while both of the arrows a, c represent positions from which the force is applied to the portions of the pressure receiving surface 28*a* which are on somewhat inner side of the outer circumference thereof. As shown in FIG. 11, the driving cam 42 is generally formed wider than the tappet 28. In an initial stage of an operation of the driving cam 41, the condition of the application of the force by the driving cam 41 to the receiving surface 28*a* is uniform over the whole of the same surface 28*a*. Accordingly, the levels of the force applied to the force applying positions represented by the arrows a, b, c are also uniform.

However, as described above, the portion of the upper surface 28*b* of the tappet 28 which is around the force applying position represented by the arrow b contacts the bulging portion of the surface 261 of the piston 26, while the portions of this surface 28*b* which are around the force applying positions of the arrows a, c have a narrow clearance between the upper surface 28*b* and the surface 261. Due to the existence of this clearance, the pressure receiving surface 28*a* is deformed as shown by a solid line in FIG. 13, and the distribution of Hertz stress during this time becomes as shown by a solid line in FIG. 14. FIGS. 13 and 14 show data obtained when a fuel discharge pressure is as high as 15 MPa.

What are shown in FIGS. 13 and 14 will now be described. The lateral axis of each of FIGS. 13 and 14 represents a position of the tappet 28 in the direction of Z-axis, and the longitudinal axis of each of FIGS. 13 and 14 a displacement distance ($\mu$m) based on the deformation of the pressure receiving surface 28*a* and measured from an initial position thereof, and Hertz stress (MPa). Each of the solid curves in FIGS. 13 and 14 shows the distribution of Hertz stress recorded when the fuel discharge pressure is 15 MPa. The a, b, c in each of these drawings represent displacement distances (FIG. 13) and Hertz stress (FIG. 14) in the force applying positions of the arrows a, b, c. As is clear from FIG. 13, the displacement distance becomes maximal around the positions of arrows a, c, and decreases at an outer circumference. As a result, the Hertz stress becomes maximal at inflexion points of the displacement distance around the arrows a, c as is clear from FIG. 13.

When the fuel discharge pressure is thus high, the abrasion of the driving cam 41 and tappet 28 increases due to the high Hertz stress occurring locally in positions around those of the arrows a, c, i.e. the positions near the outer circumference of the pressure receiving surface 28*a*. In order to deal with this problem, the related techniques employed a method of reducing Hertz stress by increasing the outer diameter of the tappet 28 and the width and outer diameter of the driving cam 41, but this method caused the dimensions and weight of the fuel supply apparatus 6 to increase.

SUMMARY OF THE INVENTION

The present invention has been made in view of the above-mentioned circumstances, and provides a fuel supply apparatus capable of reducing the abrasion of a driving cam and a tappet without increasing the dimensions and weight of the apparatus.

The fuel supply apparatus for supplying a fuel to an engine according to the present invention includes a cylinder, a piston and a tappet. The cylinder is provided with a fuel pressurization chamber having a fuel suction port and a fuel discharge port. The piston is moving slidingly in the axial direction thereof in the cylinder and thereby increasing and decreasing the volume of the fuel pressurization chamber. The tappet has a pressure receiving surface for contacting a driving cam of the engine and receiving a driving force of the driving cam, and which transmits the driving force to the piston. The tappet has a groove on its outer surface. The groove is positioned in the region which corresponds to the vicinity of an outer circumference of the pressure receiving surface for preventing the local concentration of stress thereon.

Accordingly, the groove gives an easily deformable portion of a low rigidity. The easily deformable portion is positioned in the region which corresponds to the vicinity of the outer circumference of the pressure receiving surface. The easily deformable portion works to relax the Hertz stress, and, owing to this action of the easily deformable portion, an effect of reducing the abrasion of the driving cam and tappet is obtained.

Preferably, in the fuel supply apparatus, the tappet includes a larger-diameter portion and a smaller-diameter portion. The larger diameter portion is engaged with a tappet stopper provided on an opened end portion of a cylinder casing. The smaller-diameter portion is capable of passing through the tappet stopper and has the pressure receiving surface. The groove is formed on the outer surface of the smaller-diameter portion.

Still preferably, in the fuel supply apparatus, the tappet has a board-like portion between the pressure-receiving surface and the groove. Accordingly, the board-like portion functions as a pressure receiving portion which effectively receives the driving force from the driving cam.

Still preferably, the fuel supply apparatus in which the outer diameter of the larger-diameter portion is 10 mm to 15 mm with the thickness of the board-like portion is 0.5 mm to 1.5 mm.

Accordingly, the board-like portion functions as a pressure receiving portion which effectively receives the driving force from the driving cam, without being broken even when the board-like portion receives the driving force from the driving cam.

Still preferably, the fuel supply apparatus in which the depth of the groove measured from the outer surface of the lager-diameter portion is 0.5 mm to 2 mm.

Still preferably, the fuel supply apparatus in which the groove has a V-shaped, semicircular or U-shaped cross section.

Accordingly, the easily deformable portion given by the groove maintains a low rigidity and, moreover, does not have the problem of the occurrence of the breakage thereof even when the easily deformable portion receives the driving force from the driving cam.

BRIEF DESCRIPTION OF THE DRAWINGS

Preferred embodiments of the present invention will now be described in detail with reference to the following figures, wherein.

DESCRIPTION OF THE PREFERRED EMBODIMENTS

Figure 1:
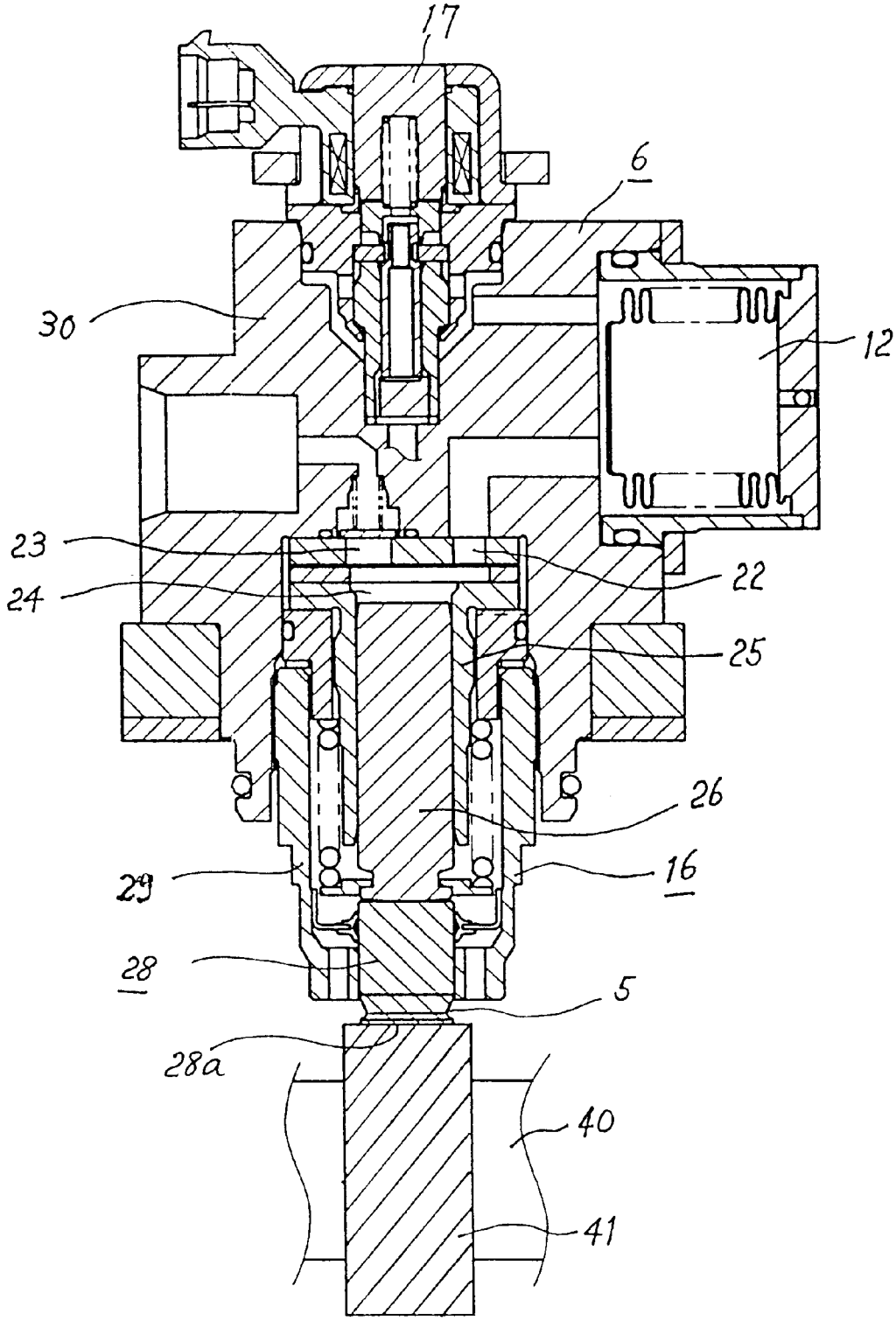
FIG. 1 is a sectional view of a first embodiment of the fuel supply apparatus according to the present invention.

In the following description, the parts identical with those of the above-described related art fuel supply apparatus and previously-described embodiments will be designated by the same reference numerals and the description thereof will be omitted in some cases.

First Embodiment

Figure 2:
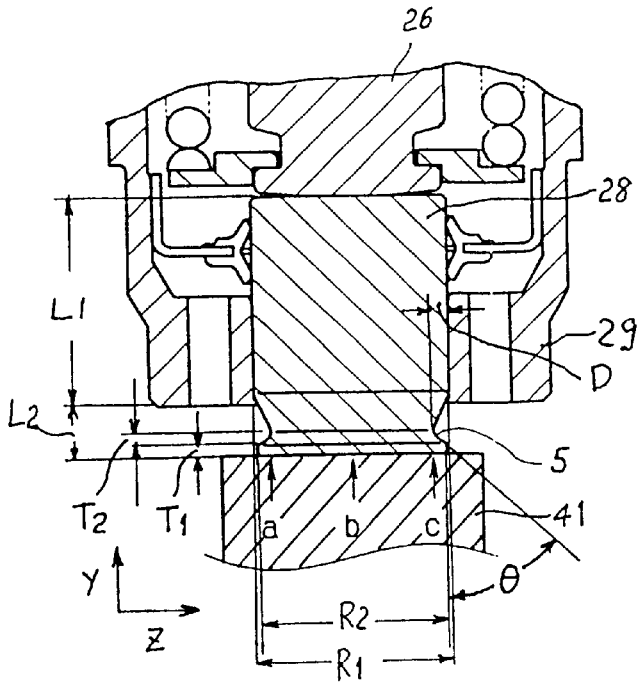
FIG. 2 is a partial enlarged sectional view of what is shown in FIG. 1.
Figure 3:
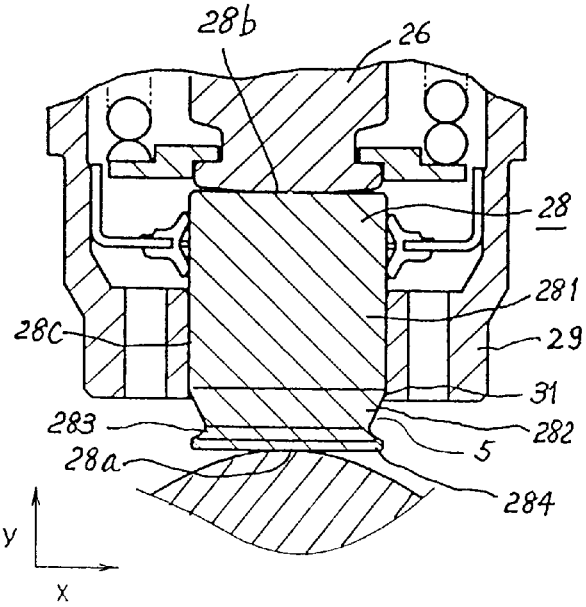
FIG. 3 is another partial enlarged sectional view of what is shown in FIG. 1.
Figure 4:
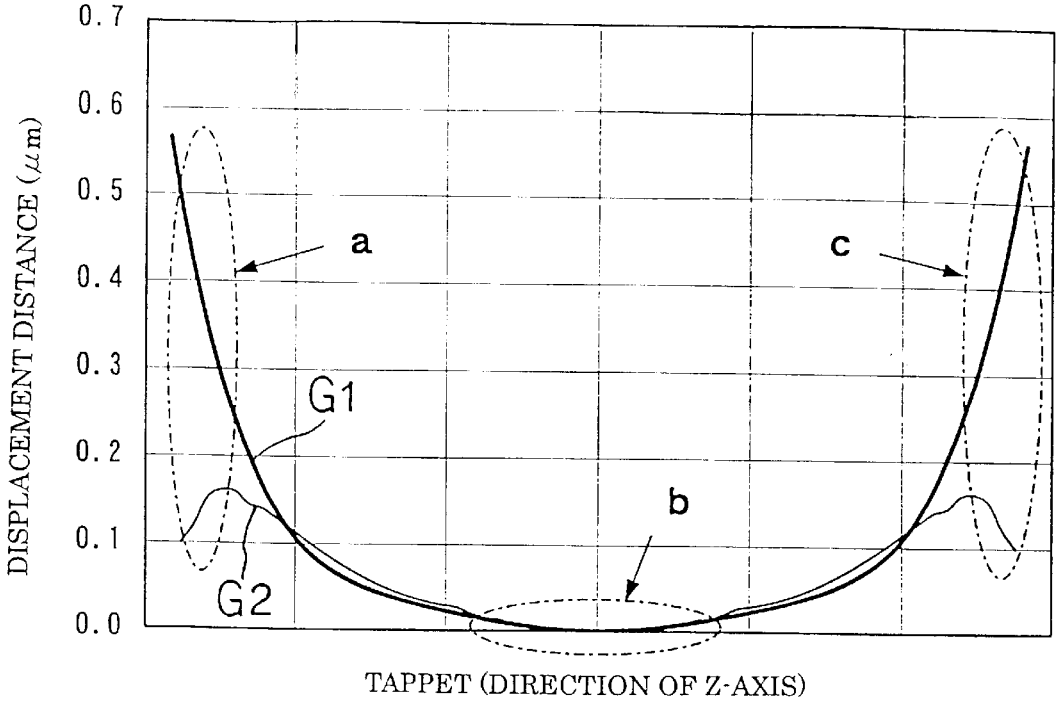
FIG. 4 is a graph showing the condition of the deformation of a pressure receiving surface of a tappet.
Figure 5:
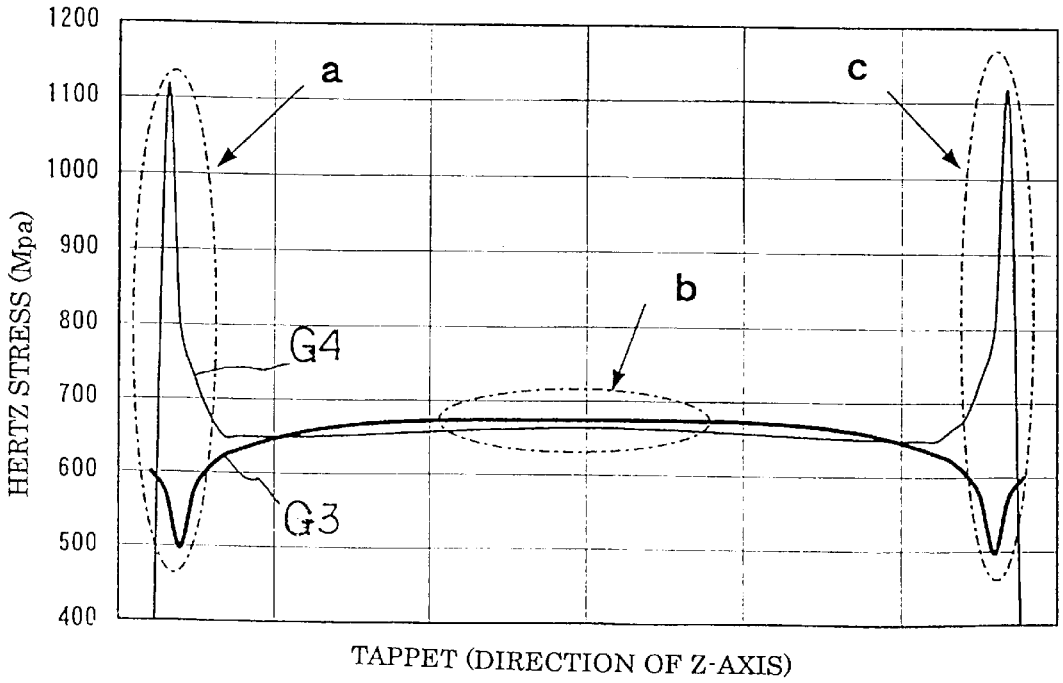
FIG. 5 is a graph showing the condition of the distribution of Hertz stress on the pressure receiving surface.
Figure 13:
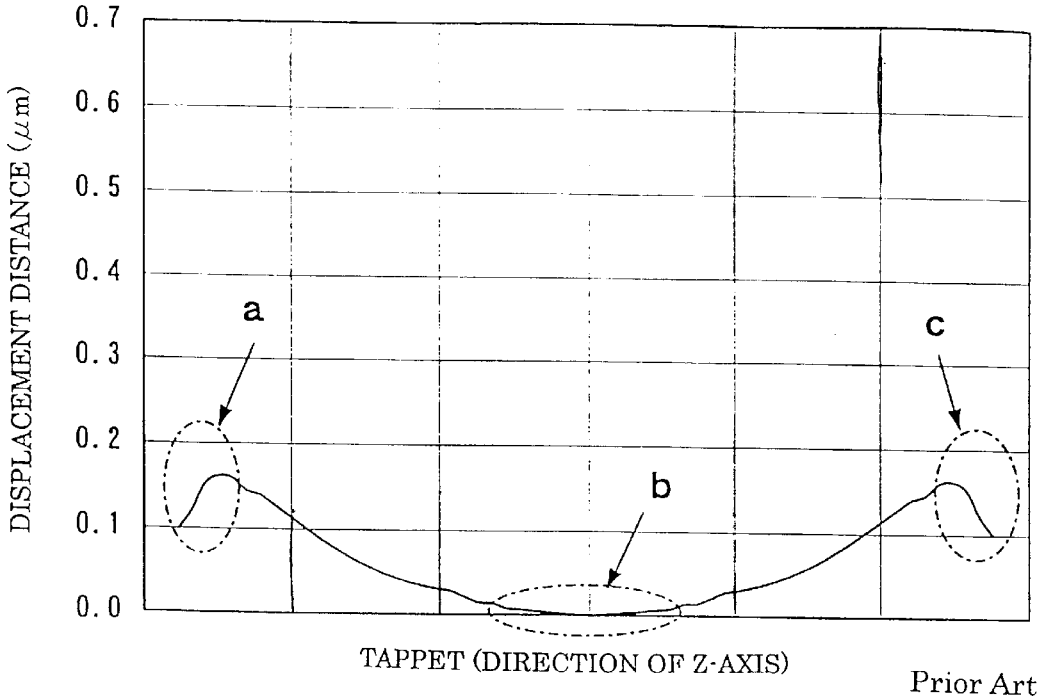
FIG. 13 is a graph showing the condition of the deformation of a pressure receiving surface of a related art tappet.
Figure 14:
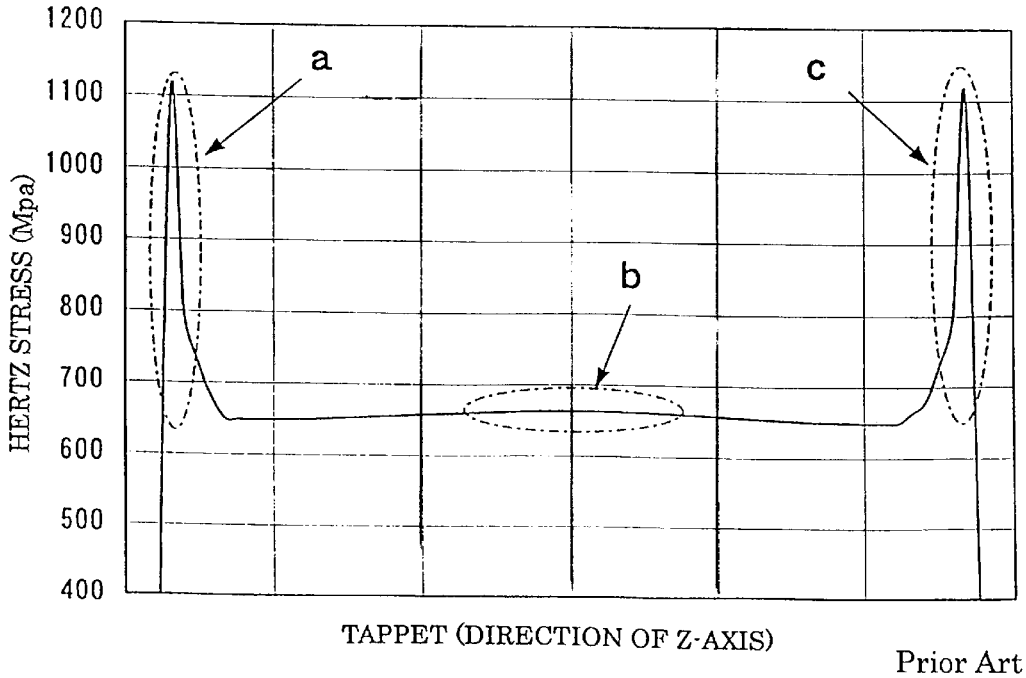
Prior Art Fig. 14
FIG. 14 is a graph showing the condition of the distribution of Hertz stress on the related art pressure receiving surface.

FIGS. 1 to 5 illustrate a first embodiment of the fuel supply apparatus according to the present invention. FIG. 1 is a sectional view of a principal portion of the fuel supply apparatus, FIG. 2 a partial enlarged sectional view taken along a plane Y-Z and illustrating the condition of the driving cam and tappet in contact with each other, FIG. 3 a sectional view taken along a plane Y-X with respect to the plane Y-Z in FIG. 2, FIG. 4 a graph showing the condition of the deformation of a pressure receiving surface of the tappet which receives a force of the driving cam, and FIG. 5 a graph showing the condition of the distribution of Hertz stress on the pressure receiving surface. What are meant by the lateral axis, longitudinal axis, and reference letters a, b, c in FIGS. 4 and 5 are the same as those in FIGS. 13 and 14. A thick curve G1 in FIG. 4 and that G3 in FIG. 5 represent the distribution of Hertz stress in the first embodiment which are recorded when a discharge pressure of the fuel is 15 MPa, and a thin curve G2 in FIG. 4 and that G4 in FIG. 5 are the reproduction of the curves shown in FIGS. 13 and 14.

Referring to FIGS. 1 to 3, especially, FIG. 3, a columnar tappet 28 has an outer surface 28*c*, and includes a larger-diameter portion 281 and a smaller-diameter portion 282, the portion of the outer surface 28*c* which corresponds to the smaller-diameter portion 282 being provided with an annular groove 5 which extends around a circumference of the outer surface. A board-like portion 284 is provided between the groove 5 and pressure receiving surface 28*a*, and a lower surface in the drawing of the board-like portion forms the pressure receiving surface 28*a*. The board-like portion 284 substantially functions as a pressure receiving portion which receives a driving force from a driving cam 41. Referring to FIG. 2, a reference symbol L1 denotes the length of the larger-diameter portion 281, L2 the length of the smaller-diameter portion, R1 the outer diameter of the larger-diameter portion 281, R2 the outer diameter of the smaller-diameter portion 282, T1 the thickness of the board-like portion 284, T2 the thickness of a thin portion 283 existing between a bottom of the groove 5 and the board-like portion 284, D the depth of the groove 5 measured from the side surface 28*c* of the larger-diameter portion 281, and θ the angle of inclination of an inclined surface of the portion of the groove 5 which is on the side of the board-like portion 284, in other words, an inclined surface of the thin portion 283.

The effect of the provision of the groove 5 will now be described. Providing the groove 5 causes the thin portion 283 and board-like portion 284 to be formed on the smaller-diameter portion 282. The outer circumferences and their near-by parts (which will hereinafter be referred to as easily deformable parts) of the thin portion 283 and board-like portion 284 are made thin and have a low rigidity. Therefore, when the pressure receiving surface 28*a* or board-like portion 284 receives the driving force from the driving cam 41, the easily deformable parts, in other words, the force applying positions indicated by arrows a and c are deformed at the outer circumference more greatly than those indicated by arrows a, c in FIG. 2. The curve G1 in FIG. 4 indicates the condition of this deformation. The curve G1 does not have inflexion points in regions of arrows a, c, as compared with the curve G2, but clearly shows that the deformation of the pressure receiving surface occurs increasingly in a monotonous manner toward an outer circumference thereof, at which the greatest deformation occurs. Since an inflexion point representing the occurrence of such large deformation does not appear, the Hertz stress in the force applying positions of the arrows a, c is sufficiently low as compared with that in the corresponding positions shown on the curve G4 as is clear from the curve G3 in FIG. 5. Therefore, it is understood that the stress relaxation with respect to the above-mentioned deformed shape of the pressure receiving surface has been achieved. The achievement of this stress relaxation is an effect obtained by the provision of the groove 5. Owing to this effect, the abrasion of the driving cam 1 and tappet 28 is reduced, and the solving of the above-mentioned object of the present invention has thus come to be attained.

In order to prevent the tappet from falling from the cylinder casing 30 during the assembling of the fuel supply apparatus 6, the tappet 28 includes the larger-diameter portion 281 having the outer diameter slightly larger than the inner diameter of a tappet stopper 31 provided in an opened portion of the cylinder casing 30; and the smaller-diameter portion 282 having the outer diameter slightly smaller than the mentioned inner diameter. During the assembling of the fuel supply apparatus 6, the tappet 28 is inserted through the cylinder casing 30 from an upper side thereof in the drawing. When the tappet 28 is thus inserted through the cylinder casing 30, the larger-diameter portion 281 alone is held in the cylinder casing 30, and the smaller-diameter portion 282 passes through the tappet stopper 31 to be put in the condition shown in FIGS. 1 to 3. In the first embodiment, the groove 5 is provided over substantially the whole region of the outer surface of the smaller-diameter portion 282 except the region thereof which corresponds to the board-like portion 284, and has a V-shaped cross section.

When the depth D of the groove 5 and the size of the opened portion are small with the thickness of the easily deformable portion being large, the rigidity of the easily deformable portion is still large. Therefore, the degree of the above-mentioned deformation (degree of stress relaxation) becomes insufficient, so that the effect of the groove 5 becomes poor. Conversely, when the depth D of the groove 5 is excessively large with the thickness of the easily deformable portion being excessively small, the grooved portion is broken in some cases due to the force of the driving cam 41. Therefore, it is preferable that the depth D of the groove 5 and the size of the opened portion be at levels between excessively high levels and excessively low levels. Such intermediate levels can be set generally by an analysis based on a rule of trial and error or a finite element method when the size of the tappet 28 are determined.

Apart from the determining by a rule of trial and error of the depth and size mentioned above, examples of optimum values of the size of the tappet 28, thickness T2 of the thin portion 283 and other sizes will be shown on the basis of FIG. 2. When the length L1 of the larger-diameter portion 281 of the tappet 28 is around 15 mm to 20 mm with R1 around 10 mm to 15 mm, the length L2 is around 4 mm to 5 mm, a difference between R1 and R2 around 0.05 mm to 0.2 mm, the thickness T1 around 0.5 mm to 1.5 mm and preferably around 0.5 mm to 1.2 mm, an angle θ of inclination around 30 to 60 degrees, the thickness T2 of the thin portion 283 around 1 mm to 2 mm, and D around 0.5 mm to 2 mm.

According to the present invention, the groove 5 is provided basically in the portion of the outer surface 28*c* of the tappet which is close to the outer circumference of the pressure receiving surface 28*a*. However, when the groove 5 is provided excessively close to the mentioned outer circumference, the thickness of the board-like portion 284 becomes excessively small, so that the board-like portion 284 is easily broken due to the force of the driving cam 41. Therefore, it is preferable that the groove 5 be provided in a position in which the board-like portion 284 can secure the thickness of around the above-mentioned level.

Second Embodiment

Figure 6:
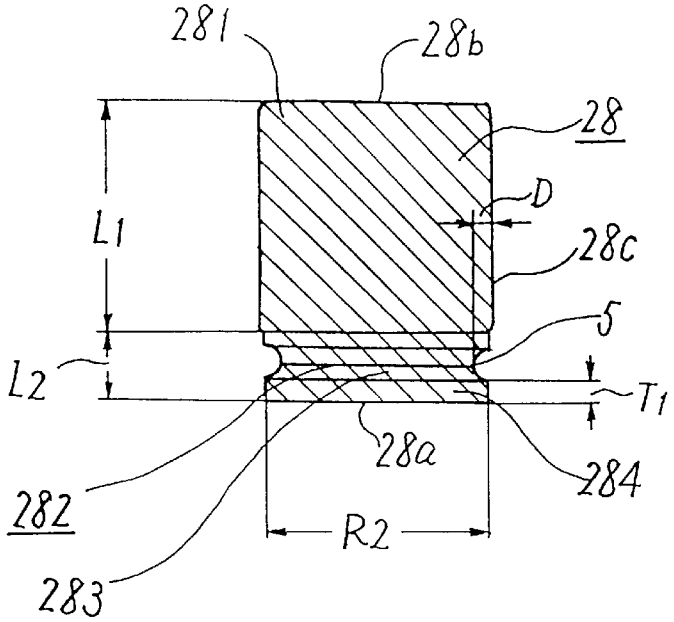
FIG. 6 is a sectional view of a tappet used in a second embodiment of the fuel supply apparatus according to the present invention.

FIG. 6 illustrates a second embodiment of the fuel supply apparatus according to the present invention, and is a sectional view of a tappet 28 only. The sectional views of a principal portion of the second embodiment of the fuel supply apparatus will be omitted since these sectional views except a sectional view of a tappet 28 are identical with FIGS. 1 to 3.

The second embodiment differs from the first embodiment only in the cross-sectional shape of a smaller-diameter portion 282 of the tappet 28, and the construction of the remaining portions of the former is identical with that of the corresponding portions of the latter. An annular groove 5 in the second embodiment has a semicircular cross-sectional shape, and the depth D thereof is equal to that of the groove 5 of the first embodiment. Although the size of an opened portion in the second embodiment is set somewhat smaller with the thickness T1 of a board-like portion 284 set somewhat larger to around 0.8 mm to 1.5 mm, the same operation and effect as in the first embodiment are obtained.

Third Embodiment

Figure 7:
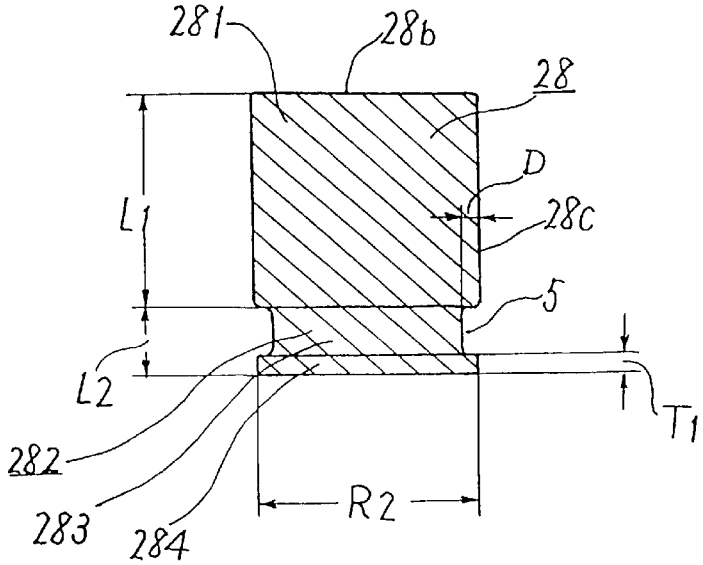
FIG. 7 is a sectional view of a tappet used in a third embodiment of the fuel supply apparatus according to the present invention.
Figure 8:
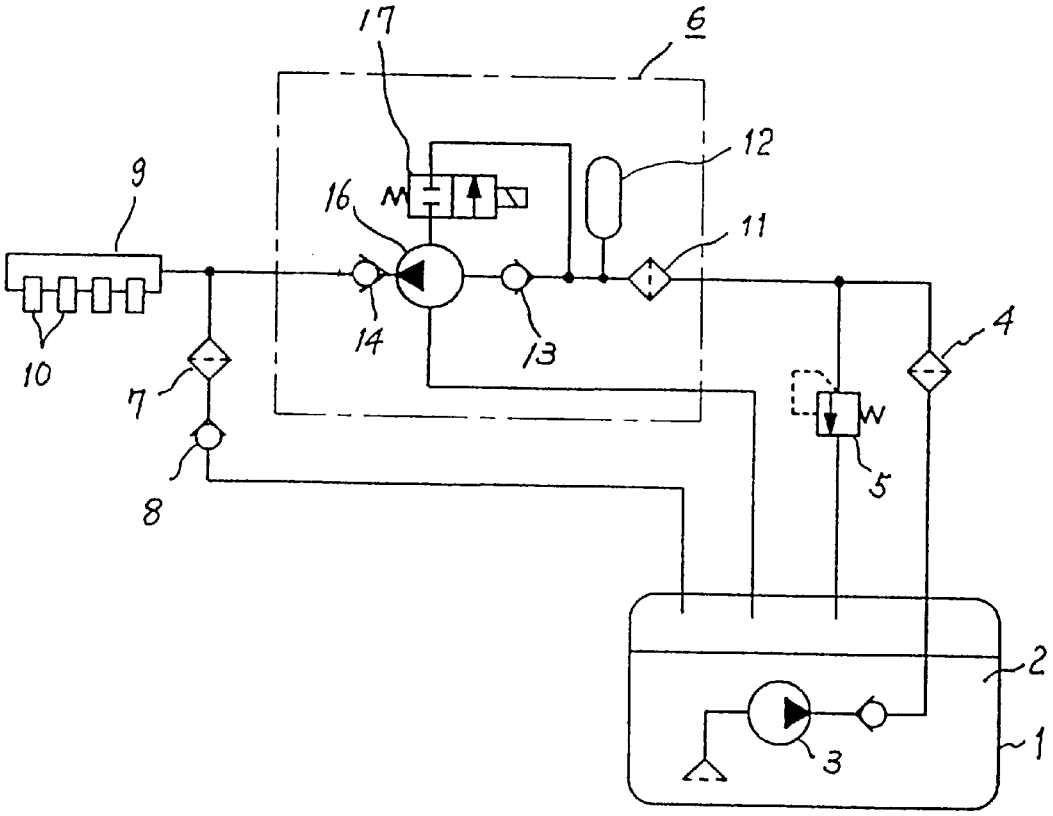
FIG. 8 is a schematic illustration of a related art fuel supply system.
Figure 9:
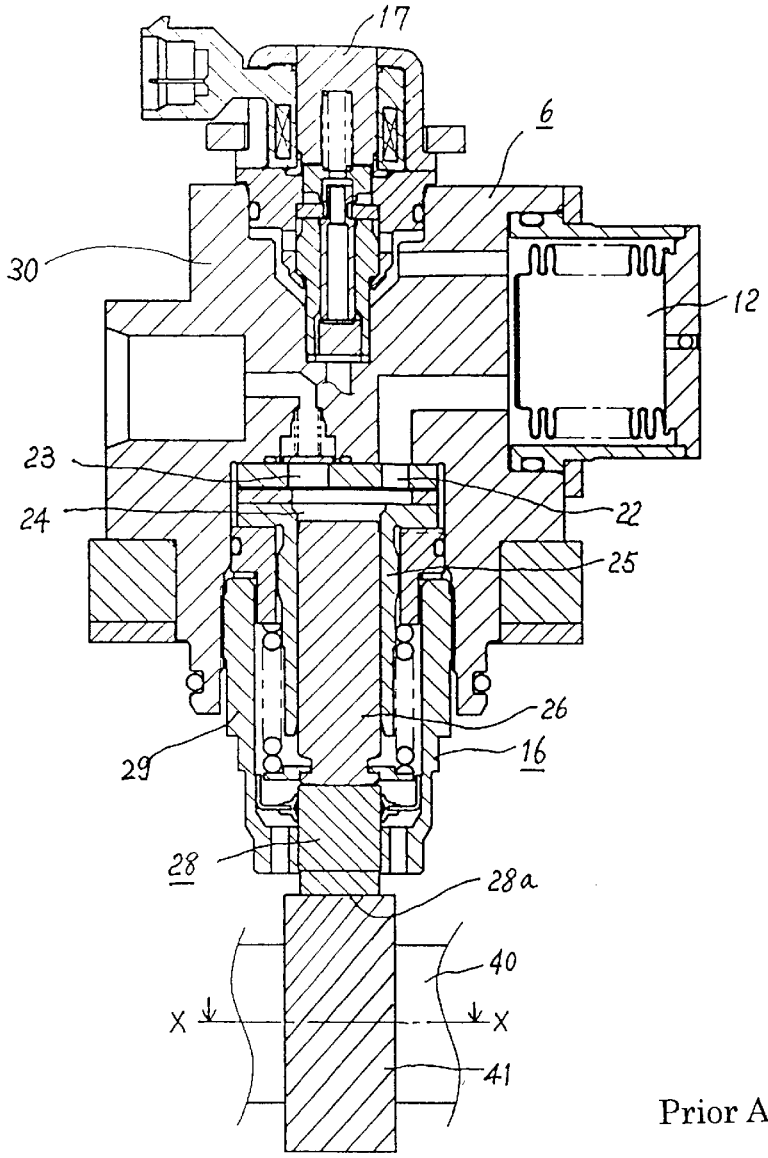
FIG. 9 is a sectional view of a related art fuel supply apparatus.
Figure 10:
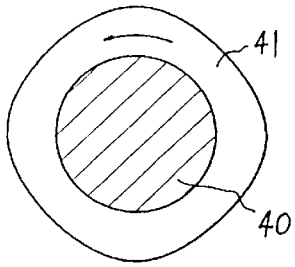
Prior Art Fig. 10
FIG. 10 is a sectional view taken along the line X—X in FIG. 9.
Figure 11:
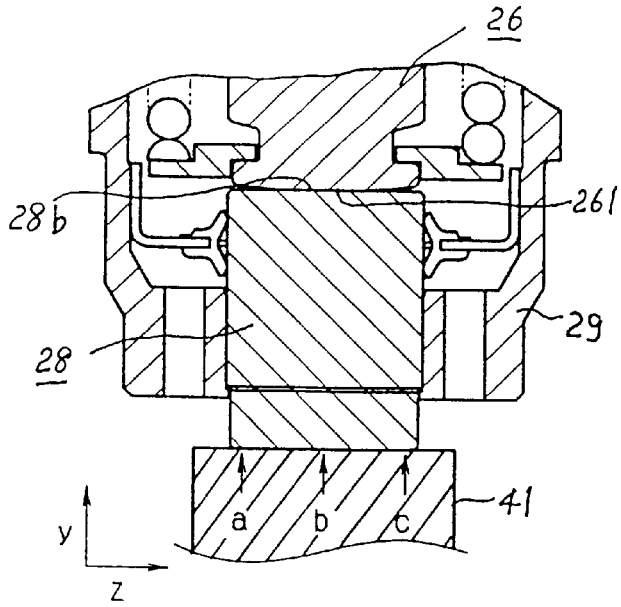
FIG. 11 is a partial enlarged sectional view of what is shown in FIG. 9.
Figure 12:
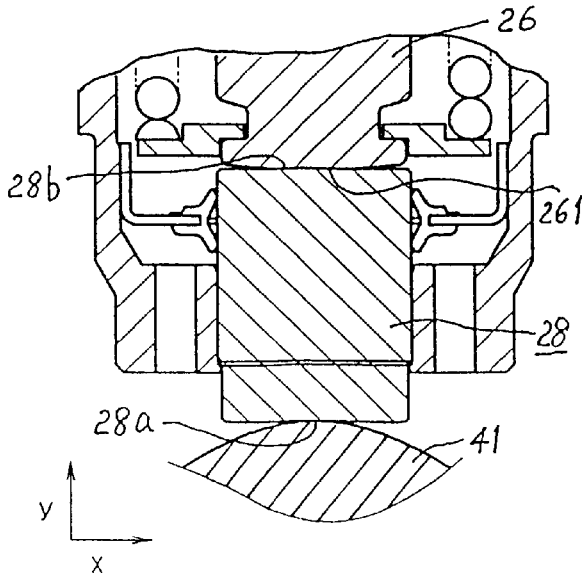
Prior Art Fig. 12
FIG. 12 is another partial enlarged sectional view of what is shown in FIG. 9.

FIG. 7 illustrates a third embodiment of the fuel supply apparatus according to the present invention, and is a sectional view of a tappet 28 only. The sectional views of a principal portion of the third embodiment of the fuel supply apparatus will be omitted since these sectional views except a sectional view of the tappet 28 are identical with FIGS. 1 to 3.

The third embodiment differs from the first and second embodiments in only the cross-sectional shapes of a smaller-diameter portion 282 of the tappet 28, and the construction of the remaining portions of the former is identical with that of the corresponding portions of the latter. An annular groove 5 in the third embodiment extends over the whole region of a smaller-diameter portion 282 except the region thereof which corresponds to the thickness of a board-like portion 284, and has a U-shaped, especially, flat-bottomed U-shaped cross-sectional shape. The thickness of the board-like portion 284 is around 0.8 mm to 1.5 mm which is equal to that of the same portion in the second embodiment. Only an outer circumferential portion of the board-like portion 284 functions as an easily deformable portion, and the operation and effect identical with those of the first embodiment is obtained.

The present invention is not limited to the above-described first, second and third embodiments but includes various modes of modifications in conformity with the spirits of the problem-solving method used in the present invention.

What is claimed is:

1. A fuel supply apparatus for supplying a fuel to an engine, the fuel supply apparatus comprising;

a cylinder provided therein with a fuel pressurization chamber having a fuel suction port and a fuel discharge port, a piston moved slidingly in the axial direction thereof in said cylinder and thereby increasing and decreasing the volume of said fuel pressurization chamber and a tappet which has a pressure receiving surface for contacting a driving cam of said engine and receiving a driving force from said driving cam, and which transmits the driving force to said piston, wherein said piston and said tappet are contacted together through a contact surface, said contact surface having a bulging portion so as to form a clearance around the bulging portion between said piston and said tappet, and wherein said tappet has a groove on its outer surface, said groove is positioned in the region which corresponds to the vicinity of an outer circumference of said pressure receiving surface for preventing the local concentration of stress thereon.

2. The fuel supply apparatus according to claim 1, wherein said tappet includes a larger-diameter portion engaged with a tappet stopper provided on an opened end portion of a cylinder casing, and a smaller-diameter portion capable of passing through said tappet stopper and having the pressure receiving surface, said groove is formed on the outer surface of said smaller-diameter portion.

3. The fuel supply apparatus according to claim 2, wherein said tappet has a pressure receiving portion between said pressure receiving surface and said groove.

4. The fuel supply apparatus according to claim 3, wherein the outer diameter of the larger-diameter portion is 10 mm to 15 mm and the thickness of the pressure receiving portion is 0.5 mm to 1.5 mm.

5. The fuel supply apparatus according to claim 4, wherein the depth of said groove measured from the outer surface of said larger-diameter portion is 0.5 to 2 mm.

6. The fuel supply apparatus according to claim 1, wherein said groove is an annular groove and has a V-shaped cross section.

7. The fuel supply apparatus according to claim 1, wherein said groove is an annular groove and has a semi-circular cross section.

8. The fuel supply apparatus according to claim 1, wherein said groove is an annular groove and has an U-shaped cross section.

* * * * *